United States Patent [19]

Olson

[11] 4,041,839

[45] Aug. 16, 1977

[54] TELESCOPIC RAM

[75] Inventor: John E. Olson, Portland, Oreg.

[73] Assignee: Cascade Corporation, Portland, Oreg.

[21] Appl. No.: 634,422

[22] Filed: Nov. 24, 1975

[51] Int. Cl.[2] ..... F01B 15/02

[52] U.S. Cl. ..... 91/189 R; 91/217; 91/422

[58] Field of Search ..... 91/168, 169, 189 R

[56] References Cited

U.S. PATENT DOCUMENTS

| | | | |
|---|---|---|---|
| 2,933,070 | 4/1960 | Trumper et al. | 91/169 |

FOREIGN PATENT DOCUMENTS

| | | | |
|---|---|---|---|
| 1,933,457 | 7/1970 | Germany | 91/168 |
| 877,869 | 9/1961 | United Kingdom | 91/168 |

*Primary Examiner*—Paul E. Maslousky

*Attorney, Agent, or Firm*—Kolisch, Hartwell, Dickinson & Stuart

[57] ABSTRACT

A multistage, extensible-contractible hydraulic ram assembly for use in conjunction with a triple-lift-type mast in a lift truck. The assembly is designed for mounting in such a truck in a so-called inverted position. It is constructed with spacial, externally actuated, internal valving which, through controlling the action of pressure fluid within the assembly, assures positive control over the sequence of movements of the sections in a mast as such as raised and lowered, without requiring latching and interlocking of these sections. Further, the assembly features the capability of producing substantially uniform or constant lifting and lowering speeds for a load which is carried out on the usual carriage mounted on a mast of the type indicated.

6 Claims, 5 Drawing Figures

TELESCOPIC RAM

BACKGROUND AND SUMMARY OF THE INVENTION

This invention pertains to a multistage, extensible-contractible hydraulic ram assembly, and more particularly to such an assembly which is especially adapted for use in conjunction with a triple-lift-type mast in a lift truck.

Many industrial lift trucks are equipped with a so-called triple-lift-type, vertically extensible-contractible mast. Such masts include inner, intermediate and outer sections which are extensible vertically relative to one another, with the inner section carrying a carriage on which any one of a variety of load-handling attachments, such as lift forks, may be mounted. The carriage is mounted for travel up and down on and along the inner mast section during what is referred to normally as the "free-lift" operating stage of a truck. Raising and lowering of the mast is accomplished through mechanism substantially always including a multisection hydraulic ram, with various sheaves and chains providing operative interconnections between the ram and the mast sections.

A number of features are usually sought in such an arrangement. To begin with, in order to avoid jolting of a load which is being handled, it is desirable that the raising and lowering speed of a load, throughout the entire vertical travel range of the load-handling attachment, be as uniform or constant as possible. It will be apparent that such jolting will occur if any abrupt changes in speed take place, and, of course, jolting presents the serious hazard of dropping a load and causing injury and damage. Further, it is desirable that the sequence in which various movable parts in and on the mast travel with respect to one another be controlled positively. In other words, for each type mast and associated carriage, there is a specific sequence of relative movements which are proper, and it is desirable to insure that nothing causes "mis-sequencing" of these parts. Further, it is well known that, because of the rough environments in which industrial trucks are often used, the more parts that are exposed on and around a mast and associated cylinder, the greater the likelihood of damage and down-time. Unfortunately, achieving of all of these desirable features in a single arrangement in the past has not been satisfactorily accomplished.

For example, efforts to produce uniform vertical travel speed for a load have resulted in compromises within ram construction which lead to mis-sequencing problems. Where rams have been constructed to produce such uniform travel speeds, sequence control has had to be performed by external latches mounted on the various mast parts, which latches produce predetermined sequenced interlocking and unlocking of the mast parts to assure positive control. Latches, of course, add considerable complexity and cost to a mast, and because of their exposed nature can easily become damaged. In masts where latching is avoided, positive sequence control has been attained through providing specially related working surface areas for pressure fluid within the associated ram—the percentage differences in the sizes of these areas positively assuring that certain parts in a ram will move before or after certain other parts. However, this approach leads, automatically, to nonuniform travel speed for a load, and thus presents the undesirable jolting problem.

A general object of the present invention is to provide a unique hydraulic ram assembly whose construction enables it to be used with a triple-lift-type mast in a manner substantially completely avoiding the problems of the past, and offering all of the features and advantages mentioned above which are considered to be desirable.

More particularly, an object of the invention is to provide such an assembly which, in and of itself, is capable of producing substantially uniform travel speed for a load, and positive sequence control over the movements of parts in a mast, without requiring any exposed external means, such as latches, for interlocking the mast sections.

A further object of the invention is to provide such a ram assembly which leads toward a relatively uncomplicated structure when combined with the mast of a lift truck —in other words, to provide an assembly which leads to a combined structure that tends to minimize the number of exposed, potentially damagable parts.

According to a preferred embodiment of the invention, which is illustrated and described hereinbelow, the proposed ram assembly may be though of as one including, essentially, a ram within a ram. More specifically, this assembly comprises an outer cylinder and an outer piston mounted for reciprocation on the outer cylinder. Nested within the outer cylinder, for relative extension in the opposite direction from the outer piston, are an inner cylinder and piston—the former functioning in many respects like another piston with respect to the outer cylinder. When mounted in place in conjunction with the mast of a lift truck, the assembly of the invention is disposed in what is referred to as an inverted position. This means that as the assembly extends, its larger diameter members are disposed generally above its smaller diameter members.

Special valving mechanism within the assembly is actuated by an external lever which senses when the assembly has reached a certain state of extension. This mechanism redirects the flow of pressure fluid in the assembly to set it up, so-to-speak, for the next stage of extension, whereby the travel speed of a carriage may be maintained substantially constant.

As will become apparent, fluid for extending the assembly from a fully contracted state is introduced through the exposed lower outer end of the inner piston, such fluid flowing therethrough into an elongated annular space on one side of the inner cylinder, and between the inner and outer cylinders, to act against the outer piston. Fluid flow into another space, on the other side of the inner cylinder, and also between the inner and outer cylinders (wherein fluid may act to extend the latter relative to the former), is accommodated by a special valve mechanism, which mechanism initially blocks such flow.

During extension of the assembly, what first occurs is that the outer piston alone moves, and extends relative to the outer cylinder. As the outer piston nears the end of its extension, it engages an external leverage assembly which actuates the valve mechanism mentioned above to permit fluid now to flow into the second-mentioned space between the outer and inner cylinders. At this point during the operation, fluid flows briefly simultaneously into both of the spaces mentioned. This flow condition smoothes the transition from the first stage of extension to the next stage. The outer piston continues to the completion of its extension, and at the same time the outer cylinder begins to extend relative to the inner cylinder.

The valve mechanism referred to above takes the form of a slidable, hollow, tubular spool, in which there is provided a central spring-biased closure device that initially blocks flow through the spool to prevent movement of the outer cylinder. It is this closure device which is later unseated as the outer piston nears the end of its extension. As the outer cylinder begins to extend relative to the inner cylinder, the spool in this mechanism shifts, eventually, relative to the inner cylinder in the same direction as the outer cylinder, and blocks a port which it previously held open that allowed fluid to flow to act on the outer piston. With such blockage, fluid acting against the outer piston becomes captured.

With continued extension of the outer cylinder, the annular space between it and the inner cylinder contracts—requiring that fluid be exhausted from this space. Such exhausting fluid is now directed through a port in the inner cylinder to act against the inner piston. As a consequence of this capturing and fluid-directing operation, the inner cylinder extends automatically relative to the inner piston.

The effective working surface areas of the various movable parts in the assembly are selected preferably to produce and extension characteristic for the assembly whereby it is capable of producing constant travel speed in a carriage on a mast. The specific relationships of such areas which provide this characteristic will be explained more fully below.

Incorporation of valving mechanism, like that just generally outlined, within the confines of the ram assembly, eliminates, as it will be seen, the necessity for using external latches. It should be noted that the valving mechanism which obviates the need for latches is itself well protected within the confines of the overall ram assembly.

These and other features and advantages which are offered by the invention will become more fully apparent as the description which now follows is read in conjunction with the accompanying drawings.

DETAILED DESCRIPTION OF THE INVENTION

Figures 1, 4, 5:
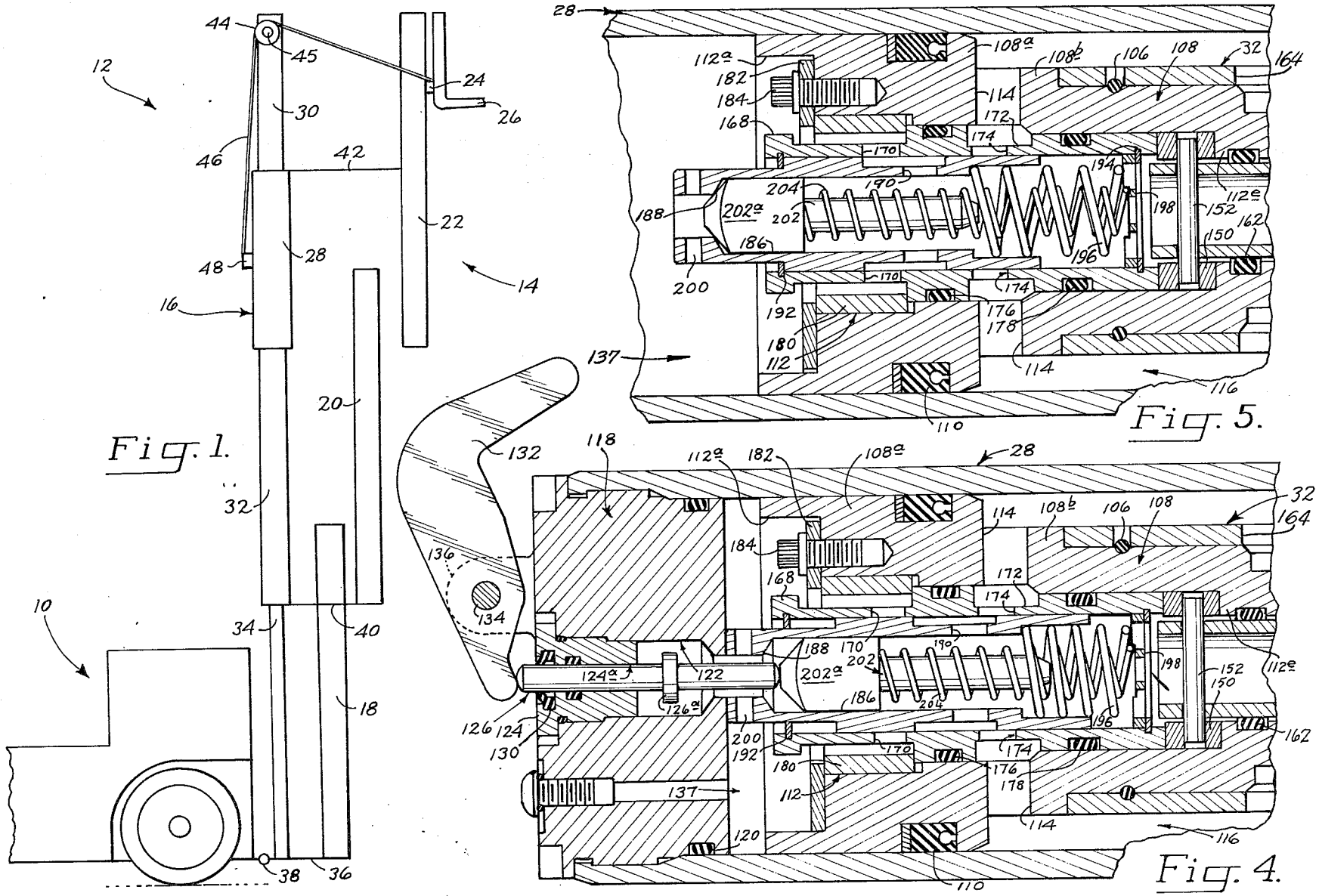
FIG. 1 is a simplified schematic diagram showing a portion of a lift truck, and of a mast and ram assembly thereon which employs a ram constructed in accordance with the present invention—the mast and ram being illustrated in fully raised or extended conditions.
FIGS. 4 and 5 show particularly a valve mechanism in the ram assembly in two different conditions during operation of the assembly.

Turning to the drawings, and referring first to FIG. 1, indicated very schematically at 10 is a partial side elevation of a lift truck, on the front of which is mounted, in the usual manner, a telescopic mast and ram assembly 12 including an extensible mast 14 and an extensible ram 16—the latter being constructed in accordance with the present invention. Ram 16 is also referred to herein as a fluid-actuated, extensible-contractible device.

Mast 14 is of the so-called triple-lift variety, and includes outer intermediate and inner mast sections 18, 20, 22, respectively. Intermediate mast section 20 is roller-mounted for vertical travel on the outer mast section, and inner section 22 is similarly mounted for vertical travel on the intermediate mast section. Neither the specific constructions of the mast sections, nor their mountings with respect to one another, form a part of the present invention, and hence, are not discussed herein in any detail.

Mounted in the usual fashion on the inner mast section is a carriage 24 which is shown herein carrying a pair of lift forks, such as fork 26. As is customary, carriage 24 is supported for travel up and down on and along inner mast section 22.

As has been mentioned previously, ram assembly 16 may be thought of as including a ram within another ram. Still referring to FIG. 1, assembly 16 comprises what might be thought of as an outer ram including an outer cylinder 28 and an outer piston 30. The assembly further comprises what might be thought of as an inner ram including an inner cylinder 32 which is telescopically mounted on outer cylinder 28, and an inner piston 34 which is telescopically mounted with respect to cylinder 32. Assembly 16 is intended for disposition, in the setting of a lift truck, in what is referred to as an "inverted" position, which simply means that its larger diameter portions, generally, are located above its smaller diameter portions. It is believed that this disposition of the assembly is clearly evidenced in FIG. 1. The various parts just mentioned in assembly 16 are also referred to as relatively reciprocable units, with cylinder 28 constituting a first such unit, cylinder 32 a second unit, piston 34 a third unit, and piston 30 a fourth unit.

The lower end of outer mast section 18 is pivoted in a conventional manner on the front end of truck 10—this connection being shown by a line 36 and a circle 38. The lower end of piston 34 is suitably seated on mast section 18, and cylinder 32 is suitably anchored to intermediate mast section 20. This anchoring connection is represented by a line 40. Further, cylinder 28 is suitably anchored to inner mast section 22—this anchoring connection being represented by a line 42.

Indicated at 44 in FIG. 1 is one of a pair of sheaves mounted through a cross head 45 on top of outer piston 30 over which is trained one of a pair of chains 46. One set of ends of these chains is anchored at 48 on cylinder 28 and the other set of ends is anchored to carriage 24.

Raising and lowering of the mast and ram assembly combination will be explained more fully later. It should be recalled at this point that these two mechanisms are shown in FIG. 1 in fully raised or extended conditions. As will further be explained, hydraulic pressure fluid for extending assembly 16 is introduced through the lower end of piston 34 from a conventional source of such fluid which is provided on truck 10.

Figure 2:
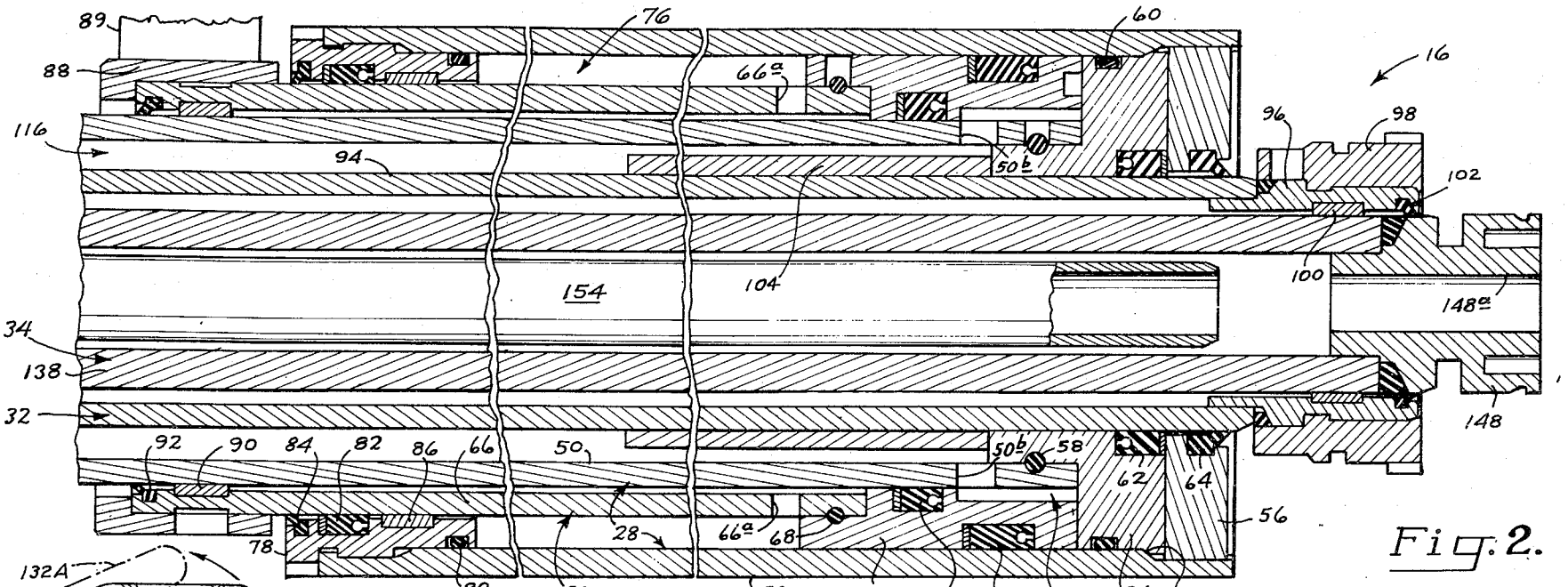
FIGS. 2 and 3, which are shown side-by-side on a single page, show opposite end portions of the ram assembly of the invention, with details of internal construction fully revealed.
Figure 3:
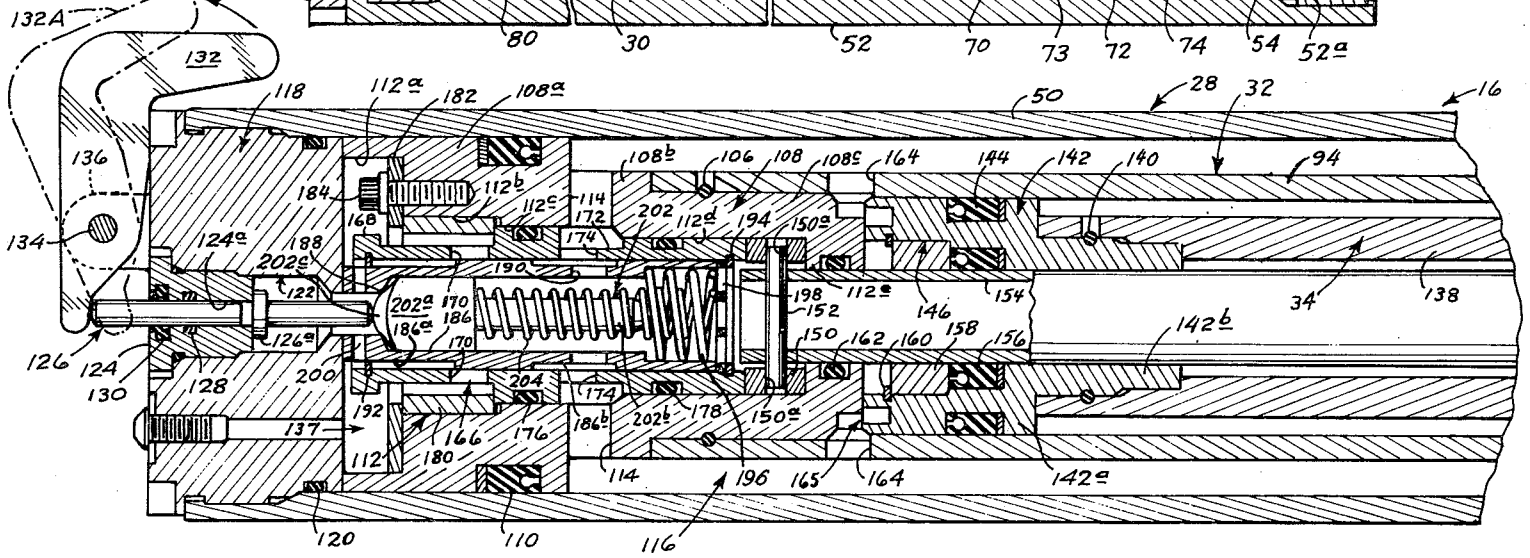

FIGS. 2 and 3 on the second sheet of drawings, taken together, show details of the construction of ram assembly 16. In order to use a sufficiently large drawing scale to enable a clear understanding of this construction, it has been necessary to cut away central portions of the ram assembly and to show opposite end portions thereof one above the other on this sheet. Further, these end portions of the ram assembly are shown with the assembly lying on its side and in a fully contracted condition. It may be useful to remember that what is shown in FIG. 2 joins axially and immediately to the right with what is shown in FIG. 3. Further, the right hand side of FIG. 2 represents the lower end of the assembly as such is depicted in FIG. 1, and the left end of FIG. 2 represents the upper end of the assembly as shown in FIG. 1. Reference will, therefore, now be made particularly to FIGS. 2 and 3 in explaining the construction of assembly 16.

Outer cylinder 28 is formed from a pair of elongated cylindrical tubes including an inner tube 50 and an outer tube 52. Inner tube 50 is smaller in diameter than tube 52, and extends substantially the full length of the ram assembly. Outer tube 52 (seen only in FIG. 2) surrounds the right end of tube 50 in FIG. 2, and is joined thereto through an annular gland 54 (having the cross-sectional configuration shown in FIG. 2), and a retaining ring 56. A snap ring 58 joins gland 54 with tube 50 as shown. The gland seats on an inclined shoulder 52*a* provided at the right end of tube 52. Retaining ring 56 is screwed into the right end of tube 52 and holds the gland against this shoulder.

Further describing the outer cylinder, the right end of tube 50 is provided with radially extending ports, such as the two shown at 50*b* in FIG. 2. Gland 54 is sealed to tube 52 through a seal assembly shown at 60. In addition, the gland carries a seal assembly 62, the purpose for which will become apparent shortly. Retaining ring 56 carries a wiper 64 whose purpose will also become apparent shortly.

Piston 30 includes an elongated tube 66 (seen only in FIG. 2) which is slightly larger in inside diameter than the outside diameter of tube 50, and somewhat smaller in outside diameter than the inside diameter of tube 52. Joined to the right end of tube 66 in FIG. 2, through a snap ring 68, is a piston head 70 which is slidably mounted within tube 52. A seal assembly 72 seals head 70 to tube 52. A seal assembly 73 seals the head to tube 50. Ports 50*b* open to chamber 74 which is defined between outer cylinder 28 and outer piston 30. The right end of tube 66 is provided with radially extending ports 66*a*, which ports are located immediately to the left of piston head 70 in FIG. 2. Ports 66*a* open to a chamber 76 which is also defined between the outer cylinder and outer piston, but which is on the opposite side of head 70 from chamber 74.

Outer piston 30 is restrained against axial retraction from the outer cylinder by means of a retaining ring 78 which is suitably joined to the left end of tube 52 in FIG. 2. Ring 78 carries a seal assembly 80 which seals between the ring and tube 52, a seal assembly 82 which seals between the ring and the outside of tube 66, and a wiper 84 which wipes against the outside of tube 66. In addition, ring 78 carries a bearing 86 which bears against the outside surface of tube 66.

Screwed onto the left end of tube 66 in FIG. 2 is a cap 88. Cap 88 carries previously mentioned cross head 45 on which sheaves 44 are mounted. The cap further carries an outwardly projecting ear 89, the purpose for which will be explained later. Also mounted adjacent the left end of tube 66 are a bearing 90 and a wiper 92, both of which ride on the outside of tube 50.

Inner cylinder 32, which appears in both FIGS. 2 and 3, includes an elongated cylindrical tube 94 which fits within previously mentioned tube 50. Joined as by welding to the right end of tube 94 in FIG. 2 is a fitting 96 onto the outside of which is screwed another fitting 98. Mounted on the inside of fitting 96 are an annular bearing 100 and an annular wiper 102, the purposes for which will be explained shortly. Fitting freely about tube 94, in the space between this tube and tube 50, is a tubular spacer 104.

Considering the construction shown at the left end of tube 94 in FIG. 3, joined to such end of this tube, through a snap ring 106, is an elongated stepped-diameter cylindrical plunger 108. Progressing axially along this plunger from its left side in FIG. 3, the plunger includes a large-diameter portion 108*a* which is slidably received within tube 50, an intermediate-diameter portion 108*b* which has an outside diameter substantially the same as that of tube 94, and a small-diameter portion 108*c* which fits snugly within tube 94 as shown. Plunger 108 is sealed to tube 50 through an annular seal assembly 110 which is mounted on the outside of plunger portion 108*a*.

Formed within plunger 108 is a stepped-diameter axially central bore 112 which includes, progressing axially along the plunger from its left side in FIG. 3, progressively smaller-diameter bore portions 112*a*, 112*b*, 112*c*, 112*d*, 112*e*. Radially extending ports, such as the two shown at 114, afford communication between bore portion 112*c* and a chamber 116 which is defined between inner cylinder 32 and outer cylinder 28.

Inner cylinder 32 is restrained against axial retraction from tube 50 (to the left in FIGS. 2 and 3) by means of a head 118 which is screwed into the left end of tube 50 in FIG. 3. Head 118 is sealed to tube 50 through an annular seal assembly 120. Provided within head 118 is an axially central stepped-diameter bore 122, the left end of which in FIG. 3 is closed off by a spool 124. Spool 124 includes an axially central bore 124*a* in which is slidably mounted a plunger 126. As can be seen, the left end of plunger 126 in FIG. 3 projects outwardly from spool 124, and the right end of the plunger extends axially to the right of the right side of head 118 in FIG. 3. Formed centrally on plunger 126 is an enlarged collar 126*a* which is shown in FIG. 3 as being seated against the right side of spool 124 in the figure. The spool and plunger are sealed together by means of a seal assembly 128. A wiper 130 is provided on the spool for wiping against the outside of the plunger.

The function of plunger 126 in ram assembly 16 will be explained shortly. Plunger 126 is actuated for its intended purpose by means of an external actuator lever 132 which is pivoted at 134 to a bracket 136 that is joined, as by welding, to the outside of head 118. Lever 132 is shown in solid outline in FIG. 3 in the position which it normally occupies with ram assembly 16 fully contracted. The lever is also shown in another position, designated 132A, to which it is swung, as will be explained to actuate plunger 126.

Previously mentioned seal assembly 62 provides a seal between gland 54 and the outside of tube 94. Previously mentioned wiper 64 wipes against the outside of this tube.

Defined between plunger 108 and head 118 is a fluid chamber 137 into which, as will become apparent, pressure fluid may be introduced to extend inner cylinder 32 relative to outer cylinder 28.

Inner piston 34 includes an elongated cylindrical tube 138 which is freely received within tube 94. Joined to the left end of tube 138 in FIG. 3, through a snap ring 140, is a stepped-diameter piston head 142. The large-diameter portion 142*a* of this head is slidably received within tube 94 and is sealed thereto through an annular seal assembly 144. The small-diameter portion 142*b* of the head is received as shown within the left end of tube 138 in FIG. 3. Formed within piston head 142 is a stepped-diameter axially central bore indicated generally at 146.

Referring to FIG. 2, joined as by welding to the right end of tube 138 in the figure is a fitting 148 which includes an axially central bore 148*a*, or conduit means, through which pressure fluid is supplied and exhausted to extend and contract assembly 16. Previously mentioned bearing 100 rides on the outside of tube 138, and previously mentioned wiper 102 wipes against the outside of this tube.

Referring particularly to FIG. 3, seated in the base of bore portion 112*d* in plunger 108 is an annular ring 150 which includes a pair of diametrically opposed, radially extending bores 150*a*. Bores 150*a* receive a pin 152 which locks in place an elongated cylindrical guide tube 154. As can be seen in FIG. 2, the right end of guide tube 154 in this figure is disposed adjacent the right end of assembly 16 with such collapsed. It will be seen in FIG. 3 that tube 154 extends snugly through the small-diameter portion of bore 146 in piston 142, and is freely received within tube 138. Piston head 142 is sealed to tube 154 through a seal assembly 156. Seal assembly 156 is held in place by means of a spacer 158, which in turn is locked in place by a means of a snap ring 160 that is joined to piston head 142. Further, tube 154 is sealed to plunger 108 by means of an annular seal assembly 162.

Fluid communication is provided between chamber 116 and the left end of piston head 142 in FIG. 3 through a plurality of radially extending ports, such as the two ports shown at 164 in FIG. 3, which ports are formed in the wall of previously mentioned tube 94. These ports open to a fluid chamber 165 which is defined between the inner cylinder and piston.

Completing now a description of the construction of assembly 16, and referring especially to FIG. 3, indicated generally at 166 is an internal valving mechanism which is important in the operation of assembly 16. Included within this valving mechanism is a generally tubular outer valve cartridge 168 which is snugly received, as shown, within portions 112*c* and 112*d* of bore 112 in plunger 108. It is believed that the axial cross-sectional configuration of cartridge 168 is clearly illustrated in FIG. 3. Opening from the central axial bore within cartridge 168 to bore portion 112*b* are radially extending ports, such as those shown at 170. Similarly, opening from the central bore in the valve cartridge to an annular channel 172 which is formed on the outside of this cartridge, in the same radial plane as previously mentioned ports 114, are ports 174.

A seal assembly 176 seals cartridge 168 to bore portion 112*c*. A seal assembly 178 seals the cartridge to bore portion 112*d*. The valve cartridge is held in place by means of a spacer 180, which is received within bore portion 112*b*, and a washer 182 which is received within bore portion 112*a*. Bolts, such as that shown at 184, secure washer 182 in place on plunger 108.

Slidably received within the central axial bore in cartridge 168 is a tubular valve spool 186 configured as shown. Spool 186 is provided with a stepped-diameter central axial bore in which there is formed a conical valve seat 188. Formed on the outside of spool 186 are two reduced-diameter portions indicated at 186*a* and 186*b*. Radially extending ports, such as that shown at 190, communicate between the hollow interior of valve spool 186 and the outside of spool portion 186*b*. The spool is captured within cartridge 168 between a pair of snap rings shown at 192, 194. Spool 186 is biased to the left in FIG. 3 by a compressed biasing spring 196 which acts between a shoulder formed within the central bore in the spool and an apertured plate 198 which is seated against snap ring 194. The left end of the valve spool in FIG. 3 is provided with radially extending bores, such as that shown at 200.

Slidably received within the central axial bore in the valve spool is a plunger 202, including a head portion 202*a* and a stem portion 202*b*. The head portion is formed with a conical nose 202*c* which seats against previously mentioned valve seat 188 (as the parts are depicted in FIG. 3). The balance of the head portion has a square cross section, as viewed along the axis of the plunger, with the corners of this cross section touching the wall of the central axial bore in the valve spool. This construction obviously results in there being four fluid passageways along the flattened sides of the head portion within the spool. The plunger is biased to the left in FIG. 3 by means of a compressed biasing spring 204, which is of smaller diameter than spring 196, and which acts between the plunger and previously mentioned plate 198.

It may be noted at this point that the various parts in ram assembly 16 which have been described herein, excepting so far as they have been shortened to fit on the sheets of drawings, are in scale with respect to one another.

Explaining now some dimensional considerations which have been taken into account in the construction of assembly 16, the effective working surface area for pressure fluid on inner piston 34, against which pressure acts to extend this piston relative to cylinder 32, is less than 50% of the effective working surface area for pressure fluid on outer piston 30 on which pressure fluid acts to extend this piston relative to cylinder 28. The first-mentioned area is that which is exposed at the left side of piston head 142 in FIG. 3. The second-mentioned area is that which is exposed on piston head 70 in chamber 74. This relationship is important, as will be explained, in assuring that, with extension and contraction of the assembly, the parts move in proper sequence. Further, in assembly 16 the effective working surface area for pressure fluid on plunger 108 which is exposed to chamber 116 is substantially exactly the same as the effective working surface area for pressure fluid on the left end of head 142. The reason for this relationship in the assembly will be explained shortly. Finally, the working surface area, mentioned above, on piston head 70 is substantially exactly the same as the sum of that on the left side of plunger 108 in FIG. 3 plus the cross-sectional area measured for the outside diameter of tube 154.

Let us consider now how the ram assembly 16 operates during extension and contraction in the setting of mast 14. As has previously been mentioned, the ram assembly when placed in use is mounted in a so-called inverted position, such as that generally illustrated in FIG. 1. Accordingly, fitting 148 forms the base of the assembly and head 118 forms the top of the assembly. A suitable fluid connection is provided with fitting 148 for the purpose of supplying pressure fluid to and exhausting it from the assembly. It will be understood that such pressure fluid will conventionally be made available by the usual source of such fluid provided in the ordinary lift truck.

Assuming that assembly 16 is connected with mast 14 as shown, and is initially fully contracted, and further assuming that all of the fluid chambers in the assembly are properly filled with fluid, then when pressure fluid is admitted to the assembly through fitting 148, what first occurs is that outer piston 30 extends upwardly relative to outer cylinder 28, along tubes 50, 52. It will be assumed that throughout extension of assembly 16, pressure fluid is supplied at a substantially constant rate. It will be noticed that a fluid communication path is provided for accomplishing this—such path including tube 154, the hollow interior of spool 186, ports 190, 174, channel 172, ports 114, chamber 116, ports 50*b*, and chamber 74. It will be noticed that with the conical nose portion of plunger 202 seated against valve seat 188, such pressure fluid initially acts only on the right side of plunger 108 in FIG. 3. Hence, there is no tendency to extend inner cylinder 32 relative to outer cylinder 28. In fact, initially supplied pressure fluid tends to maintain plunger 108 seated as shown. Pressure fluid does, however, act initially on inner piston 34, but because the working surface area on this piston, mentioned earlier, has the relationship previously described with respect to that on the outer piston, the outer piston will automatically move first. Further, it will be appreciated that so long as the outer piston is free to move (i.e., is not blocked against moving) this situation will remain the same, and the inner piston will continue to occupy the position shown for it in FIGS. 2 and 3 within inner cylinder 32. In other words, where the ram is to be used connected with a mast and carriage as shown in FIG. 1, by making the effective working surface area on the inner piston less than 50% of that on the outer piston, positive control over the initial sequence of movements of parts is effected, whereby the inner piston remains stationary relative to the inner cylinder, and the outer piston, to the exclusion of all other parts in assembly 16, alone moves.

As the outer piston nears the limit of its stroke, ear 89 on cap 88 engages lever 132, and causes this lever to swing, as shown in FIG. 3, toward the position illustrated for it at 132A. It will be seen that such swinging of the lever causes the same to act on plunger 126 so as to drive this plunger inwardly against plunger 202, thus to unseat the latter from valve seat 188. With consequent opening of the central bore in spool 186, pressure fluid now flows past plunger 202 through the bore, and through bores 200 into chamber 137.

As a consequence of this situation, pressure fluid now acts to extend inner cylinder 32 relative to outer cylinder 28. Such initial extension of the inner cylinder occurs simultaneously with completion of the stroke of the outer piston. This simultaneous action smooths the transition between what might be thought of as the initial stage of extension in the ram assembly, and the subsequent stage of extension.

Referring now to FIGS. 4 and 5 along with the other drawing figures, in FIG. 4 inner cylinder 32 is shown in a position where it has shifted slightly away from head 118. Spool 186 is still bottomed out against the head because of the combined actions of springs 196, 204. And in this connection, it will be noted that spool 186 has shifted relative to cartridge 168. It will thus be noted that under this circumstance, fluid flow is simultaneously permitted not only to chamber 137 to cause the inner cylinder to move, relative to outer cylinder 28, but fluid flow is still possible into chamber 116 to complete the stroke of the outer piston.

With continued extension of assembly 16, and slight further shifting of the inner cylinder away from head 118, valve spool 186 shifts completely away from the head, and plunger 202 shifts away from plunger 126. When this condition exits, spring 204 returns plunger 202 to a position seating against valve seat 188. This is illustrated clearly in FIG. 5. Further, spring 196 biases the valve spool to the position shown for it in FIG. 5. When this situation exists, it will be noted that pressure fluid can still flow into chamber 137, such flow now taking place through a portion of the central bore in the valve spool, ports 190 and ports 170. Further, it will be noted that the valve spool is now in a condition blocking flow into chamber 116. As a consequence, fluid in chamber 116, and in all chambers communicating therewith, is, in effect, captured.

As the inner cylinder continues to extend relative to the outer cylinder, and because of the fact that the volume of chamber 116 is now contracting due to such extension, fluid in this chamber is pumped through ports 164 so as to flow now into chamber 165 and against piston head 142. As a consequence, the inner piston now simultaneously extends relative to the inner cylinder as the latter extends relative to the outer cylinder. Because of the equality of the working surface areas on that portion of plunger 108 which is exposed to chamber 116, and on piston head 142, inner piston 34 extends relative to inner cylinder 32 at substantially exactly the same rate that the latter extends relative to outer cylinder 28.

Because of the area relationships mentioned above, the inner cylinder now extends relative to the outer cylinder at the same rate at which the outer piston initially moved relative to the outer cylinder. During this secondary stage of extension of the assembly, the pressure of fluid in chamber 116, and in all of the other chambers which communicate therewith, will be appreciably higher than the pressure of fluid in chamber 137. This is because of the relative sizes of the working surface areas mentioned earlier. As a result, outer piston 30 is positively held in its extended condition on the outer cylinder during the time that the inner cylinder and piston extend relative to each other and to the outer cylinder. This is an extremely important feature in continuing to assure postive control over the sequence of movements of parts.

Contraction of assembly 16 takes place with exactly the reverse sequence of events occurring. During such contraction, positive sequence control is still maintained. Thus, what first occurs is that inner piston 34 contracts relatively into inner cylinder 32 simultaneously with the latter contracting at the same rate relatively into outer cylinder 28. Outer piston 30 remains in its condition of full extension relative to the outer cylinder. As the inner cylinder and piston near their bottomed-out conditions, spool 186 and plunger 202 go through a reverse sequence of movements so as once again to open up chamber 116 for communication with the main supply of pressure fluid, and so as eventually to close off the central bore in valve spool 186. With consequent releasing of the pressure fluid in chamber 116, the outer piston is now free to contract on the outer cylinder.

So long as the rate of exhaust of fluid from the ram is maintained substantially constant, the overall contraction rate of the ram follows the reverse pattern described above.

Considering now how assembly 16 works in conjunction with mast 14, and referring to FIG. 1, during the initial stage of extension, with the outer piston alone moving, sheaves 45 are raised to act on chains 46, with the result that carriage 26 is lifted on inner mast section 26. It will be obvious from the sheave and chain arrangement shown that the carriage travels at a vertical speed which is substantially exactly twice the vertical speed of the outer piston.

During the next stage of extension, inner cylinder 32 rises on inner piston 34, and outer cylinder 28 rises on inner cylinder 32. As this occurs, outer cylinder 28 directly lifts the inner mast section through the connection represented by line 42, and inner cylinders 32 directly lifts the intermediate mast section through the connection represented by line 40. As has previously been mentioned, assembly 16 and mast 14 are shown in FIG. 1 in substantially fully extended conditions.

Thus, it will be apparent that the ram assembly of the invention meets all of the objectives, and offers all of the features and advantages, ascribed to it earlier herein. In addition to such features which have already been discussed, another feature is that the outside exposable surface of inner piston tube 138 is not used as a sealing surface between the inner piston and the inner cylinder. It will be recalled that seal assembly 156 is carried on piston head 142, and wipes on the inside protected surface of tube 94. This offers an important advantage in assuring the integrity of a seal between the inner piston and cylinder.

While a preferred embodiment of the invention has been described herein, it should be appreciated that variations and modifications may be made without departing from the spirit of the invention.

It is claimed and desired to be secured by Letters Patent:

1. A fluid-actuated extensible-contractible device comprising first, second and third operatively associated, relatively reciprocable units, means defining a fluid chamber between said first and second units out of which, due to contraction of said chamber, fluid flows with extension of said second unit relative to said first unit, means defining a fluid chamber between said second and third units into which fluid flows with extension of said first unit relative to said second unit, and valve means mounted within said second unit for controlling the sequence of movements of said units, said valve means including a slidably movable valve spool operatively associated with said chambers, and operable, as a result of extension of said second unit relative to said first unit, to shift from one position allowing the escape of fluid from said first-mentioned chamber toward another position blocking such escape and capturing fluid in said two chambers, whereby to effect the transfer of fluid from said first-mentioned chamber to said second-mentioned chamber during extension of said second unit relative to said first unit to cause, as a result of such transfer alone, simultaneous extension of said third unit relative to said second unit.

2. A fluid-actuated extensible-contractible device comprising first, second and third operatively associated, relatively reciprocable units, means defining a fluid chamber between said first and second units out of which, due to contraction of said chamber, fluid flows with extension of said second unit relative to said first unit, means defining a fluid chamber between said second and third units into which fluid flows with extension of said first unit relative to said second unit, and valve means mounted within said second unit for controlling the sequence of movements of said units, said valve means including a slidably movable valve spool operatively associated with said chambers, and operable, as a result of extension of said second unit relative to said first unit, to shift from one position allowing the escape of fluid from said first-mentioned chamber toward another position blocking such escape and capturing fluid in said two chambers, whereby to effect the transfer of fluid from said first-mentioned chamber to said second-mentioned chamber during extension of said second unit relative to said first unit, with all fluid during such transfer that leaves the first-mentioned chamber entering the second-mentioned chamber, and all fluid that enters the second-mentioned chamber coming from the first-mentioned chamber, such transfer causing simultaneous proportional extension of said third unit relative to said second unit.

3. A fluid-actuated extensible-contractible device comprising first, second and third nested, relatively reciprocable units, said first unit forming a cylinder slidably receiving said second unit, and said second unit forming a cylinder slidably receiving said third unit, a changeable-volume fluid chamber between said first and second units out of which, due to contraction of said chamber, fluid flows with extension of the second unit relative to the first unit, another changeable-volume fluid chamber, between said second and third units, into which fluid flows to produce extension of the third unit relative to the second unit, and valve means mounted within said second unit for controlling the sequence of movements of said units, said valve means including a slidably movable valve spool operatively associated with said chambers, and operable, as a result of extension of said second unit relative to said first unit, to shift from one position allowing the escape of fluid from said first-mentioned chamber toward another position blocking such escape and capturing fluid in said two chambers, whereby to effect the transfer of fluid from said first-mentioned chamber to said second-mentioned chamber during extension of said second unit relative to said first unit, with all fluid during such transfer that leaves the first-mentioned chamber entering the second-mentioned chamber, and all fluid that enters the second-mentioned chamber coming from the first-mentioned chamber, such transfer causing simultaneous proportional extension of said third unit relative to said second unit.

4. A fluid-actuated extensible-contractible device comprising first, second, third and fourth operatively associated, relatively reciprocable units, a plurality of fluid chambers including one between said first and second units out of which, due to contraction of said one chamber, fluid flows with extension of said second unit relative to said first unit, another between said second and third units into which fluid flows with extension of said third unit relative to said second unit, and a third between said first and fourth units into which fluid flows to produce extension of said fourth unit relative to said first unit, said other and third chambers communicating under all circumstances with said one chamber, conduit means connected to one of said units for the supply and exhaust of fluid with respect to said chambers to extend and contract the device, and valve means within said device operatively interposed between said conduit means and said chambers for controlling the distribution of the fluid in the chambers during extension and contraction of the device, thereby to control the sequence of movements of said units, said valve means, with the device fully contracted, and with pressure fluid supplied to said conduit means, enabling such fluid to flow from the conduit means through said one chamber to said third chamber to cause extension of said fourth unit relative to said first unit exclusive of movement in any other unit, and with full extension of said fourth unit, blocking communication between said conduit means and said one chamber, and capturing fluid in said one, other and third chambers, whereby any extension thereafter of said second unit relative to said first unit pumps fluid from said one chamber to said other chamber to cause simultaneous extension of said third unit relative to said second unit.

5. The device of claim 4 which further includes a fourth chamber between said first and second units into which fluid flows to cause extension of the second unit relative to the first unit, and wherein said valve means, when in a condition enabling communication between said conduit means and said one chamber, blocks communication between the conduit means and the fourth chamber, and when in a condition capturing fluid as indicated, enables communication between the conduit means and the fourth chamber.

6. The device of claim 4, wherein the working surface areas in said units on which fluid acts to produce extensions are sized whereby, for a given rate of supply of fluid in said conduit means, the travel speed of said fourth unit relative to said third unit during extension of the fourth unit relative to said first unit is substantially one-half that of said first unit relative to said third unit during relative extension of said first, second and third units.

* * * * *